US005372425A

United States Patent [19]

Tannenbaum et al.

[11] Patent Number: 5,372,425

[45] Date of Patent: Dec. 13, 1994

[54] CUSHIONED RESTRAINING DEVICE FOR SHAKER APPARATUS

[75] Inventors: Myron Tannenbaum, Cranbury; Alan L. Husson, Long Valley; Michael A. Gut, Jackson; James Bright, East Brunswick, all of N.J.

[73] Assignee: New Brunswick Scientific Co., Inc., Edison, N.J.

[21] Appl. No.: 128,364

[22] Filed: Sep. 28, 1993

Related U.S. Application Data

[63] Continuation-in-part of Ser. No. 938,431, Aug. 31, 1992, abandoned.

[51] Int. Cl.[5] ..... B01F 11/00

[52] U.S. Cl. ..... 366/208; 366/111; 366/209

[58] Field of Search ..... 366/208, 209, 210, 211, 366/212, 110, 111, 112; 248/632, 634, 636, 638

[56] References Cited

U.S. PATENT DOCUMENTS

| | | | |
|---|---|---|---|
| 2,433,509 | 12/1947 | Drescher | 248/632 |
| 3,281,125 | 10/1966 | Shoe et al. | 366/111 |
| 4,202,634 | 5/1980 | Kraft et al. | 366/208 |
| 4,326,389 | 4/1982 | Frost | 366/209 |
| 4,750,845 | 6/1988 | Nabetani | 366/208 |
| 4,845,025 | 7/1989 | Lary et al. | 366/111 |
| 4,893,780 | 1/1990 | Koseki | 248/638 |
| 4,893,938 | 1/1990 | Anderson | 366/208 |
| 5,052,812 | 10/1991 | Tannenbaum et al. | 366/209 |
| 5,186,406 | 2/1993 | Romanelli | 242/54 R |

*Primary Examiner*—David A. Scherbel
*Assistant Examiner*—Reginald L. Alexander
*Attorney, Agent, or Firm*—Robert S. Stoll

[57] ABSTRACT

A shaker apparatus having a platform for carrying a load, a supporting base disposed beneath said platform, drive means carried by the base and operatively connected with the platform to provide horizontal shaking of the platform in an orbital motion with respect to the base, eccentric idler devices connecting the base to the platform for maintaining the platform in a substantially planar orbit substantially parallel to the base during the horizontal shaking of the platform and to eliminate backlash, and alignment elements associated with the eccentric idler devices to prevent the transmission of rigid, non-yielding force loadings between the platform and the base through one of the eccentric idler devices when the force loadings are generated at another of the eccentric idler devices or by the drive means. A second embodiment includes alignment and support structure to prevent transmission of rigid, non-yielding force loadings and to support the platform.

21 Claims, 5 Drawing Sheets

CUSHIONED RESTRAINING DEVICE FOR SHAKER APPARATUS

BACKGROUND OF THE INVENTION

This application is a continuation-in-part of copending application U.S. Ser. No. 07/938,431, filed Aug. 31, 1992, now abandoned.

While the invention relates to a wide range of applications, it is especially directed to an apparatus for shaking a load and more specifically to an orbiting motion shaking machine for controlled mixing of chemicals, biological cultures and the like. In particular the invention is directed to reducing vibration of the shaking apparatus due to heavy or unbalanced loads and misalignment of the structural elements of the shaking apparatus.

Prior art shakers for agitation and mixing chemical and biological fluids is accomplished with precision in laboratory and production facilities with shakers as disclosed in U.S. Pat. Nos. 3,002,895, 3,430,926, 3,601,372, 3,830,474, 4,750,845 and 4,971,276. Such shakers are adapted to carry a variety of containers on a platform which is motor-driven through a drive geometry capable of high speed and high eccentric forces to obtain the desired mixing or agitation over a specified period of time.

It is known though the prior art that orbiting motion machines which are driven with an eccentric motion require a restraining device to keep the shaking load support platform from rotating. Also, the platform must be kept parallel to the machine base and free of backlash to maintain even mixing patterns. A variety of techniques and structures have been incorporated in prior art shaking apparatus to address these concerns.

For example, as disclosed in U.S. Pat. No. 3,430,926, a center eccentric shaft is coupled to a tier plate and restrained by four eccentric idlers. This was a successful design. However, with shaking apparatus designed for heavier loads together with increased orbital speeds, the existing eccentric idler bearing designs have become insufficient, under some conditions, to avoid vibration and eventual self-destruction of the shaker.

More specifically, to overcome the design limitations of the prior art devices, such as accurate positioning of the eccentric idlers, was very difficult to achieve. Further, maintaining the tier plate in a parallel orientation to the base is difficult with the newer shaking machines designed for heavier loads. The failure to precisely position the idlers and/or properly maintain the orientation of the tier plate to the base causes stresses on the multiple idler bearings and frame which reduce equipment life and increase costs for repairs or replacements.

OBJECTS AND SUMMARY OF THE INVENTION

It is an object of the present invention to provide a shaker apparatus that obviates one or more the limitations and disadvantages of the described prior arrangements.

It is a further object of the present invention to provide a shaker apparatus which can operate with unbalanced loads.

It is a still further object of the present invention to provide a shaker apparatus that does not transfer rigid, non-yielding loads between idler bearings causing damage to the apparatus and/or reduction of bearing life.

It is a yet further object of the invention to provide a shaker apparatus wherein the need for precision in assembly is reduced so that the apparatus is less expensive to manufacture and rebuild.

It is a still another object of the present invention to provide a shaker apparatus wherein smaller and less expensive bearings can be utilized.

It is another object of the invention to provide a shaker apparatus which includes idler mechanisms that both allow for some angular misalignment and provide support for the vibrating tier plates.

According to the present invention, a shaker apparatus is provided with an orbiting motion, shaking a plurality of platforms for mixing fluids. The platforms are positioned above a base and connected thereto by a center eccentric shaft. The shaft passes through and is operatively connected to the platforms. Eccentric idler retainers connect the platforms to the base. The idler retainers include alignment components for preventing the transmission of force loadings between the platform and the base through misalignment of one or more of the eccentric idler retainers.

Further, in accordance with the invention, each of the idler retainers include bumpers, i.e. o-rings, which enable the retainers to align themselves both horizontally and vertically to eliminate or cancel out misalignment of multiple idler bearings and off-center loads. The bumpers also provide a cushioning effect within the idler retainers which reduces the noise level during the operation of the apparatus.

Also, in accordance with the invention, the shaker apparatus can be housed in a sealed, environmentally controlled room. The control panel for directing the operation of the speed control for the motor driving the shaker can be located outside of the room and connected to the speed control by fiber optics.

In accordance with a second embodiment of the invention, a shaker apparatus comprises a platform structure for carrying a load and a base disposed beneath the platform structure. A drive device carried by the base and operatively connected with the platform structure causes horizontal shaking of the platform structure with respect to the base. A plurality of idler eccentric components connect the base to the platform structure for guiding the platform structure in a substantially planar orbit substantially parallel to the base during the horizontal shaking of the platform structure. Alignment and support structure associated with each of the idler eccentric components prevents the transmission of rigid, non-yielding force loadings between the platform structure and the base through misalignment of the idler eccentric components and for supporting the platform structure and preventing any significant up and down motion of the platform structure with respect to the base.

The invention and further developments of the invention are now elucidated by preferred embodiments shown in the drawings.

DESCRIPTION OF THE PREFERRED EMBODIMENT

Figure 1:
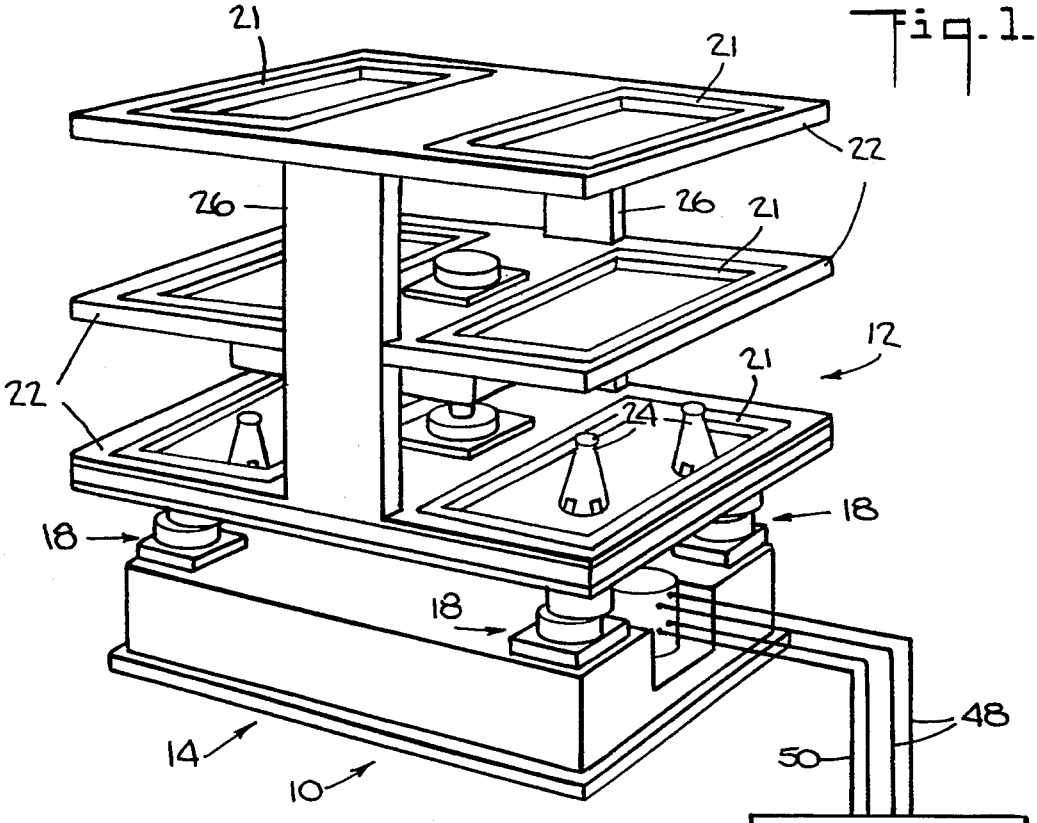
FIG. 1 is a schematic illustration of an orbiting motion shaking apparatus connected to a motor speed control and master controller.
Figure 2:
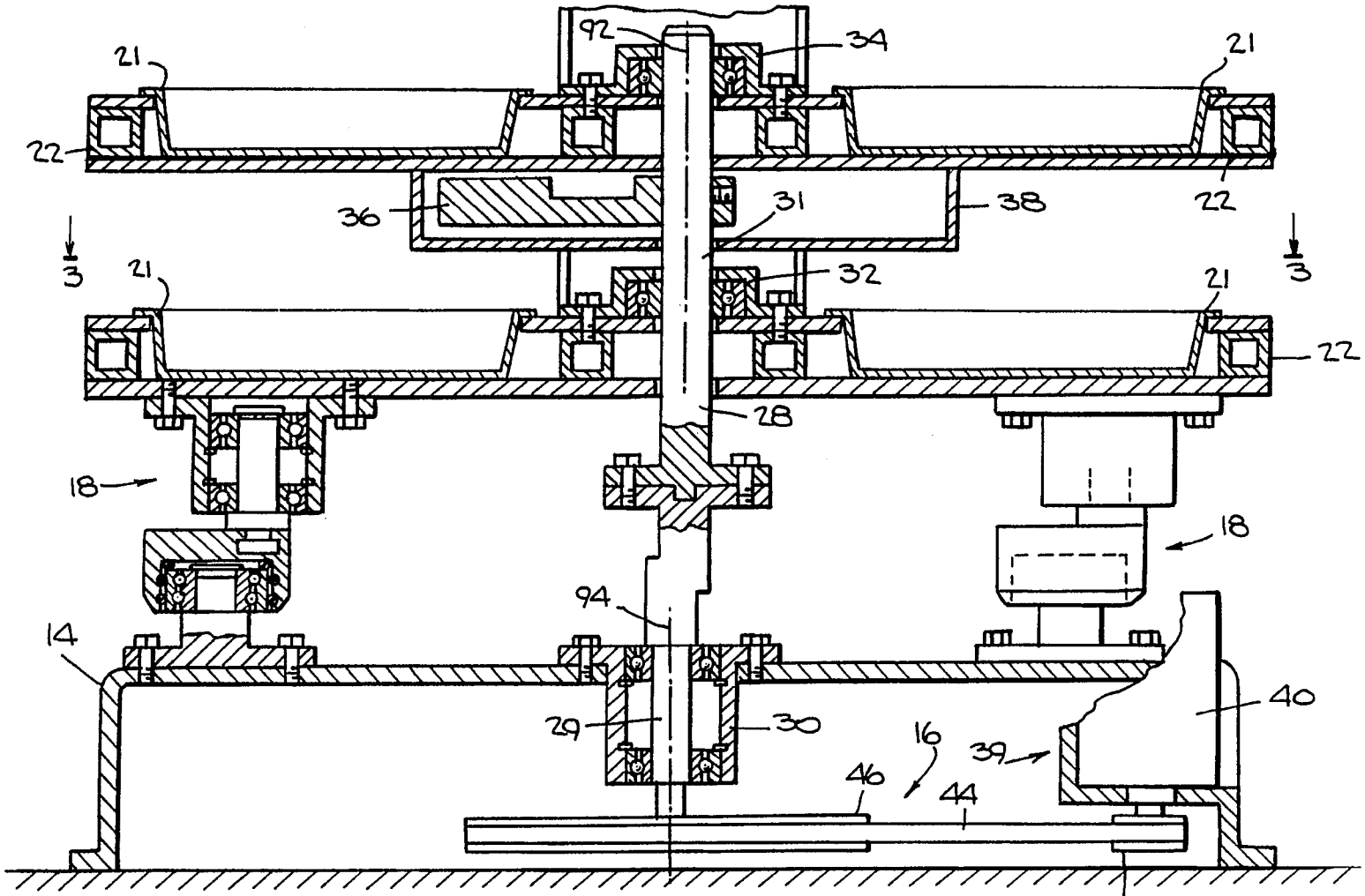
FIG. 2 is a side view, partly in cross-section, of a shaking apparatus in accordance with the present invention.

Referring to FIGS. 1 and 2, there is illustrated a schematic of an orbiting motion, shaking apparatus 10 adapted for shaking fluids, such as biological and chemical, being mixed. The apparatus 10 includes a platform or tier structure 12 for carrying a load. A base 14 is disposed beneath the platform. A drive device 16, carried by the base 14, is operatively connected with the platform structure 12 for horizontal shaking of the platform structure 12 with respect to the base. A plurality of idler eccentric elements 18 connect the base 14 to the platform structure 12 for maintaining the platform structure in a substantially planar orbit substantially parallel to base 14 during the horizontal shaking of the platform and to eliminate backlash. Alignment components 20 are associated with each of the idler eccentric elements 18 for preventing the transmission of rigid, non-yielding force loadings between the platform structure 12 and the base 14 through one of the idler eccentric elements 18 when the force loadings are generated at another of the idler eccentric elements 18.

The orbiting motion shaker apparatus 10, as illustrated in FIG. 1, has six, open rectangular load platforms or tiers 22 for supporting containers 24 of fluids to be mixed. While six platforms are illustrated, it is within the terms of the invention to use any desired number of platforms of any desired construction. The platforms can be secured to structural members 26. The platforms are located above a heavy, substantially rectangular shaped base 14 and supported thereto by a plurality of accentric idler retainers or elements 18. Preferably, the idler retainers 18 are located at each corner of the base and attached to the four corners of the lowermost platform. However, it is within the terms of the invention to use fewer retainers 18, such as two, or more retainers as desired. The details of the construction and operation of the retainers 18 are provided hereinafter.

The platforms 22 are operatively connected to the base 14 by a drive device 16. The drive device includes an eccentric shaft 28 which is carried by and rotatably received at its lower end 29 within a bearing device 30 secured to the base 24. The upper end 31 of the eccentric shaft extends through and is rotatably secured within bearing devices 32 and 34 to the lower and middle platforms. The vertical weight of the platforms and the loads may be carried by the four accentric elements 18. A counterbalance device 36 is secured to the upper portion of the accentric shaft between the lower and middle platforms. The vertical weight of the counterbalance device 36 may be carried by the center drive shaft 28. Preferably, the counterbalance is disposed within a housing 38. The counterweight 36 rotates with the shaft 28 and acts to horizontally balance the apparatus 10 and to substantially eliminate tilting moments about a horizontal axis, as generally discussed in U.S. Pat. No. 3,430,926. Platforms 22 are configured to receive removable trays 21.

Figure 3:
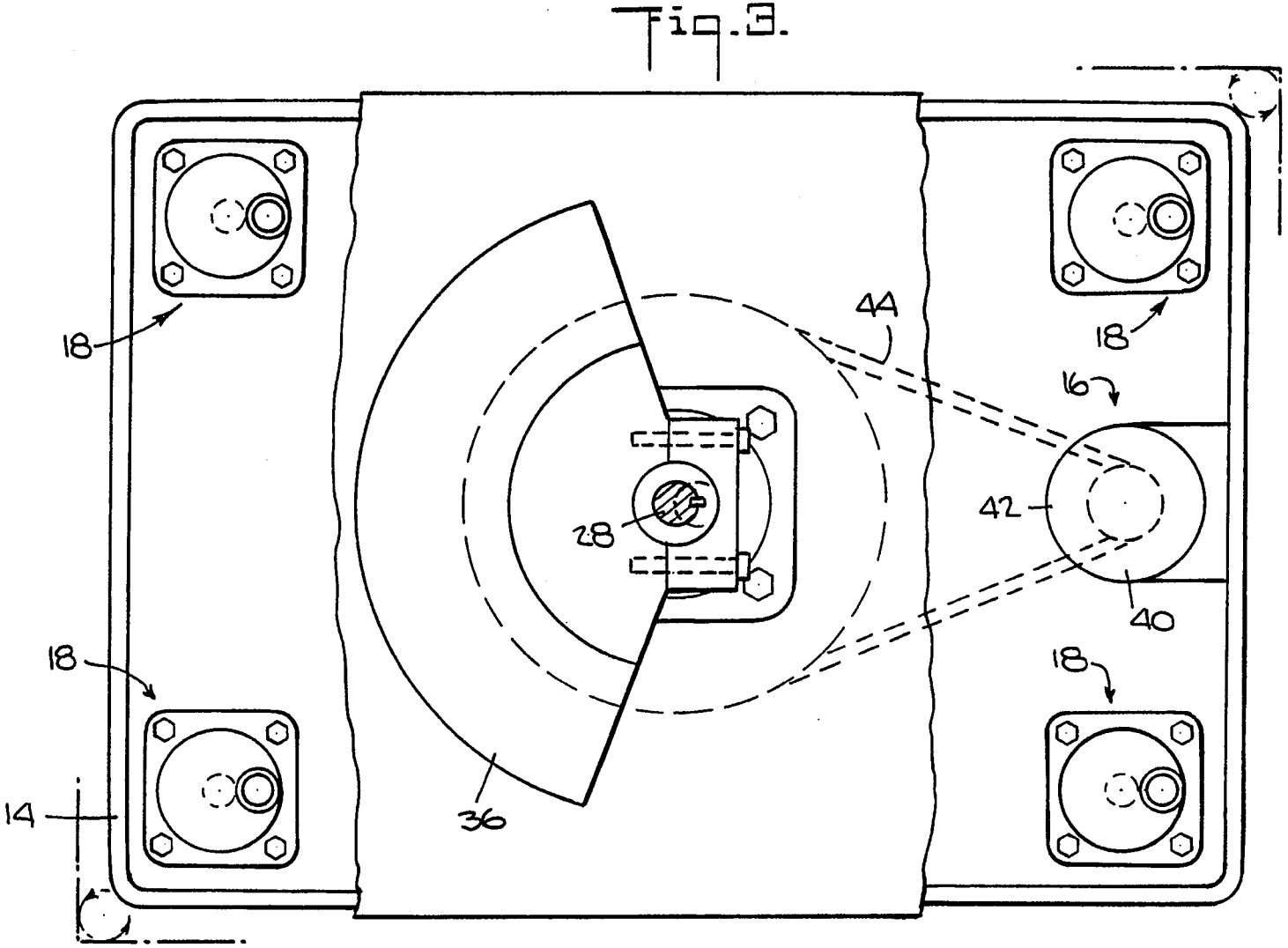
FIG. 3 is a view through line 3—3 of FIG. 2.

Referring to FIGS. 1, 2 and 3, the drive mechanism or device 16 includes a motor means 39 for rotating the drive shaft. The motor means 39 includes a motor 40 carried by the base 14 and driving a pulley 42 which transmits the drive though a belt 44 to a pulley 46 coaxially fixed to the bottom end of the drive shaft 20. The drive device 16 also includes a speed control means 47 connected to the motor 42 for controlling the speed of rotation of the drive shaft to create the desired orbit of motion. The speed control 47, although illustrated in FIG. 1 as being separated from the base 14, is preferably mounted to the base so that heavy power wiring 48, typically copper, is kept as short as possible to increase the efficiency of the apparatus and decrease the possibility of wire breakage. In addition, fiber optic lines 50 may be connected between the speed control means 47 and the motor 40 to provide command signals and feedback. The fiber optic lines send signals to monotor and maintain the speed of the motor at a desired level.

The drive device 16 further includes a master remote control means 52 connected to the speed control 47 for setting control parameters of the latter. The shaker apparatus 10 can be housed in a special room which can be environmentally controlled and sealed. Therefore, a remote control device 52 can be located outside of the room so that the room need not be unnecessarily opened. Fiber optic lines 54 and 56 connect the remote control 52 to the speed control 47. One of the fiber optic lines, i.e. 54, can provide a command signal to the speed control 47. A conventional digital bandpass filter, not shown, can be provided to select the frequency of the pulses passing from the control 52 to the speed control 47. The other optic line 56 can provide a feedback line carrying a signal corresponding to the frequency of pulses generated by an encoder in the tachometer.

Figure 4:
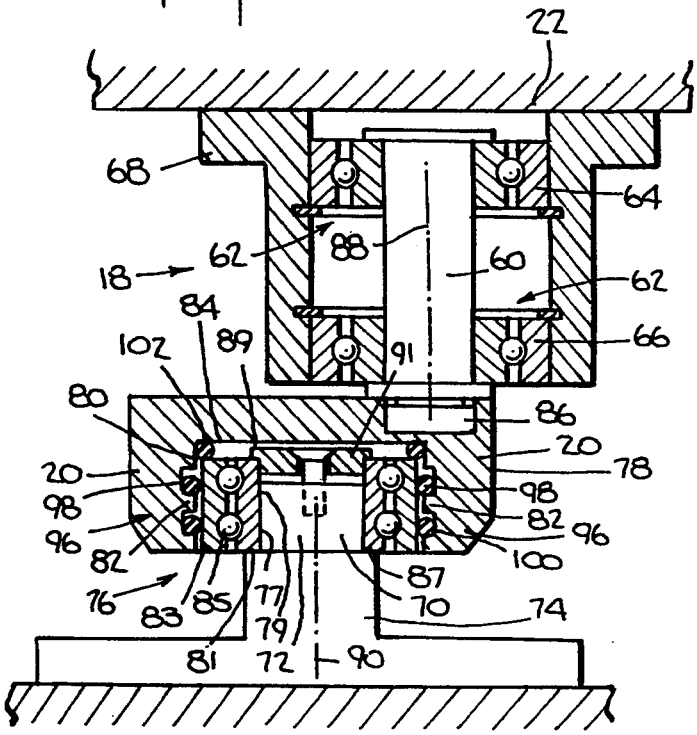
FIG. 4 is an enlarged side view, in cross section, of an eccentric idler retainer incorporating an alignment structure in accordance with the invention.

Referring to FIGS. 2 and 4, the details of the idler eccentric retainers 18, arranged at the corners of the base 14 and the lower platform 22 are now set forth. Each of the retainers 18 are used to couple the lower platform to the base. Each of idler eccentric retainers comprises an upper shaft or journal portion 60 in an upper bearing assembly 62 secured to the platform 22. The upper journal 60 rotates within bearing assembly 62 which includes two bearings 64 and 66. The latter bearings are secured to a housing 68 which is secured to the bottom surface of the lower platform.

A lower shaft or journal portion 70 comprises an idler 72 which extends upward from an idler post 74. The idler post is secured to the base 14. A lower bearing assembly 76 is secured to the idler 72. The lower bearing assembly 76 has a double row bearing 77, which includes an inner cylindrical element 81 secured to the idler 72 and a movable outer cylindrical element 83.

Two ball bearings 85, between the inner and outer elements 81 and 83, allow the outer element 81 to freely rotate. The inner elements 81 of lower bearing is seated on a shoulder 87 between the idler 72 and the idler post 74. A lip 89 on a plug element 91 presses against the upper surface of inner element 81 of the lower bearing assembly and forces double row bearing 77 against the shoulder 87 when the plug is secured into position by any means such as a screw.

The idler eccentric 18 further includes a cup component 78 disposed about the lower bearing assembly 76 and secured to the upper journal 60. The cup 78 has a closed cavity 80 formed of a cylindrical inner side wall 82 and a bottom surface 84. The cup 78 is disposed about the lower bearing assembly 76 and secured to the lower end 86 of the upper journal 60.

The upper and lower journals 60 and 70 each have first and second longitudinal axes 88 and 90, respectively, extending therethrough. The first and second longitudinal axes are substantially parallel to and offset from each other the same distance as between the parallel axes 92 and 94 extending through the lower and upper ends 29 and 31 of the drive Shaft 28. The cup component 78 rotates about an axis which coincides with the second longitudinal axis 90 in response to a circular orbital movement of the upper journal 60 which is secured to the lower platform and thereby moved by the orbital rotation of the upper end 31 of the drive shaft.

An important aspect of the invention relates to the alignment means 20 disposed between the cup 78 and the lower bearing assembly 76 to prevent contact of the cup 78 with the lower bearing assembly 76.

Idler eccentric retainers are load bearing and as shown in the prior art, as in U.S. Pat. No. 3,430,926, require alignment to closer than about 0.001 inches to about 0.002 inches. Any misalignment causes stress and flexing in the platforms. The term "misalignment", as used in the present specification, means that pressure is exerted against the outer element 83 of bearing assembly 76 so that it does not move freely about the inner element (81). Misalignment is typically caused by inaccurate positioning of the idler retainers with respect to each other or unbalanced loads on the platforms. The present invention eliminates the need for extremely close tolerances.

The alignment means 20 of the present invention includes bumper means 96 between the closed cavity 80 of the cup component 78 and the lower bearing assembly 76 to prevent contact of the cup 78 with the lower bearing assembly. The bumper means 96 comprises a first bumper i.e. o-rings 98 and 100, between the-inner side wall of the cup means and the outwardly turning wall of the outer element 83 of the lower bearing assembly, and a second bumper i.e. o-rings 102, between the bottom surface of the cavity and the upper wall of outer element 83 of the lower bearing assembly.

In assembling the apparatus 10, the cup 78 with the o-rings 98, 100 and 102 in place can be slipped over the lower bearing 76 arranged, as illustrated in FIG. 4. Then, each idler assembly can be slipped into place between the lower platform and the base. The upper housing 68 and the idler post 74 are bolted into place. By slowly rotating the platform and the base, respectively, the bolts can be snugged and then tightened. Because the o-rings tend to self center, the adjustment is relatively easy. It is important to note that the o-rings 98, 100 and 102 enable the cup 78, and with it upper shaft 60, to give or move horizontally, vertically and angularly with respect to the lower shaft 70.

A number of significant advantages can be realized with this novel alignment means 20. The platforms can be operated with unbalanced loads. With the bumper means 96, there is no loading of the system between the bearings in different idler elements 18 which otherwise create stresses that can crack the platforms and/or reduce bearing life. The flexible cushioning provided by the bumper means 96 prevents metal to metal contact and thereby reduces operating noise. The self alignment of the idler assemblies incorporating the alignment components 20 compensates for inaccuracies in positioning of the idler assemblies as well as the offset of the upper and lover journals 60 and thereby reduces the cost of fabrications. The platforms can be run at higher speeds, i.e. increased by about 100 rpm.

Even at the higher operating speed, the reduced resistance in the bearings of the idler retainer lowers the horsepower requirements of the motor and allows for the use of smaller and less expensive bearings in the idler retainers. Moreover, the platforms can be operated at higher speed without side play or lash and effects a motion that ensures mixing of liquid containers irrespective of their location on the platforms.

Figure 5:
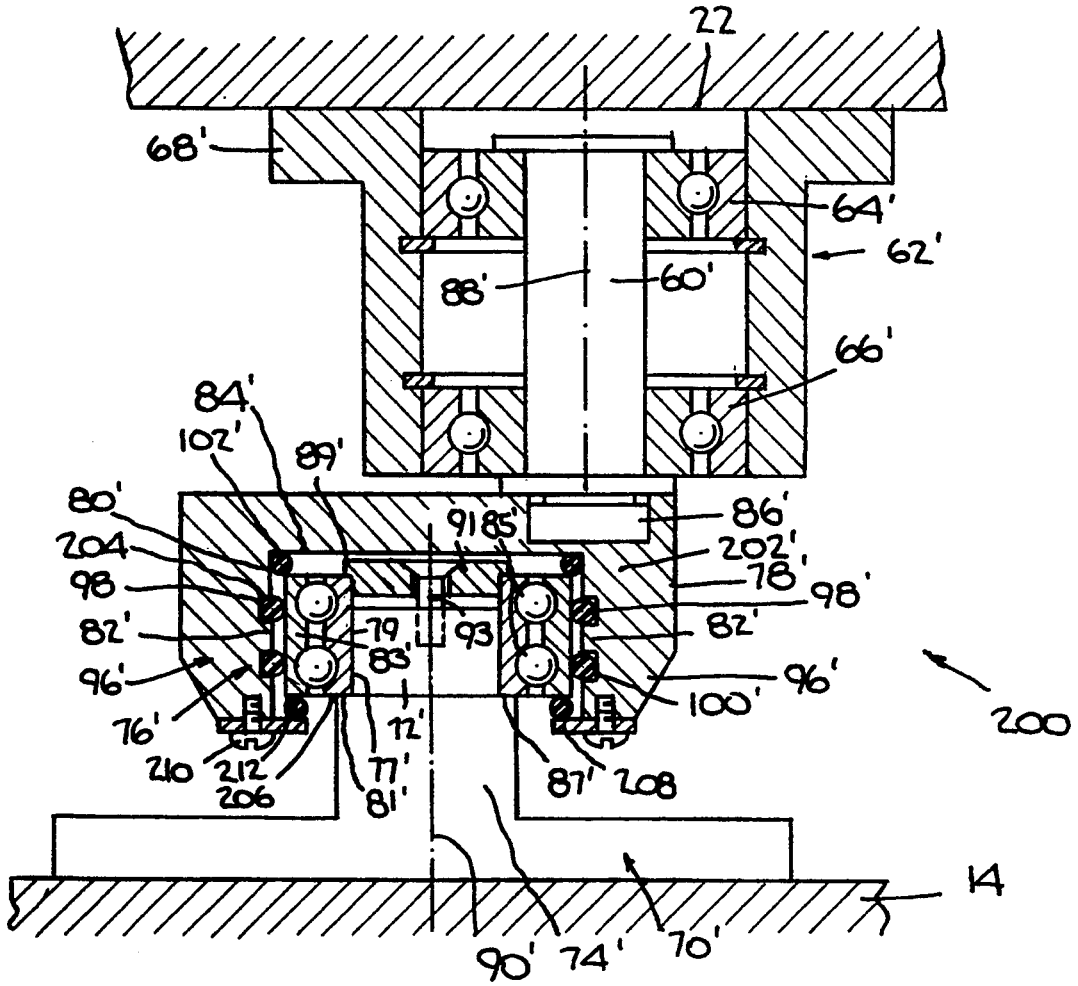
FIG. 5 is an enlarged side view, in cross section, of a second embodiment of an eccentric idler retainer incorporating an alignment and support structure in accordance with the invention.
Figure 6:
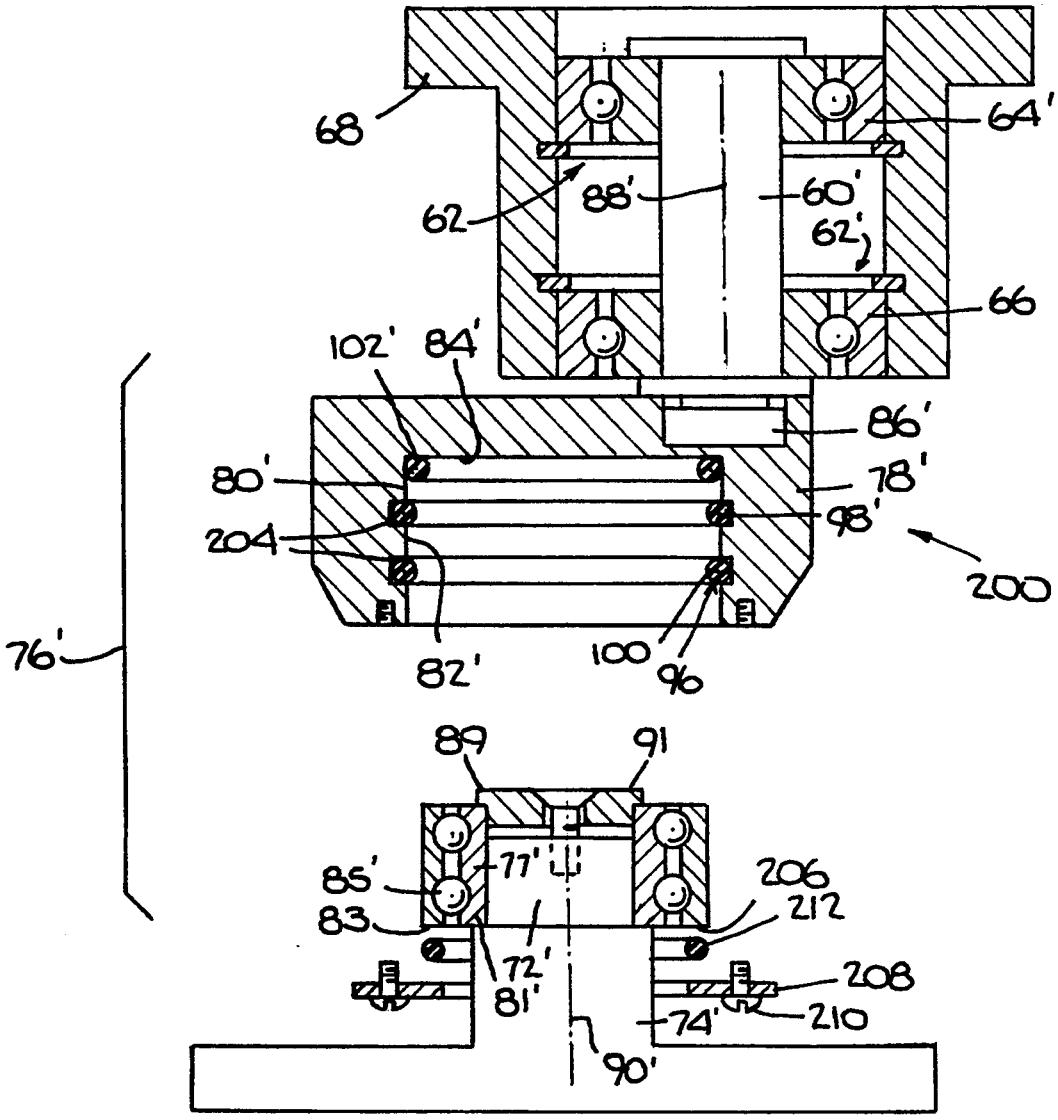
FIG. 6 is an exploded view of the second embodiment of the eccentric idler.

While the above described embodiment of the invention provides a very effective means of preventing misalignment by inaccurate positioning of the idler retainers with respect to each other or unbalanced loads on the platforms, it is also within the terms of the invention to provide an alternative embodiment where idler eccentric retainers 18 are replaced with idler eccentric retainers 200, as illustrated in FIGS. 5 and 6. The idler eccentric retainers 200 prevent platform structure 12 from rotating about center shaft 28 as well as supporting the platform structure 12 and preventing any up and down motion with respect to base 14.

Referring to FIGS. 5 and 6, the details of the idler eccentric assemblies 200, arranged at the corners of base 14 and the lower platform 22, are now set forth. Each of the assemblies 200, coupling lower platform 22 to base 14, comprises an upper shaft or journal portion 60' which is rotatably secured within an upper bearing assembly 62'. Throughout the specification, primed numbers represent structural elements which are substantially identical to structural elements represented by the-same unprimed number. The bearing assembly 62' includes two bearings 64' and 66' which are secured to a housing 68', which in turn is mounted to the bottom surface of lower platform 22.

A lower shaft or journal portion 70' comprises an idler 72' which extends upward from an idler post 74' that is secured to base 14. A lower bearing assembly 76', secured to idler 72', has a double row bearing 77' with an unmovable inner cylindrical element 81' secured to idler 72' and a movable outer cylindrical element 83'.

Balls 85' between the inner and outer elements 81' and 83' allow the outer element 83' to freely rotate. The lower bearing assembly 76' is seated on a shoulder 87' between idler 72' and idler post 74'. A lip 89' on a plug element 91' presses against the upper surface of inner cylindrical element 81' and forces bearing 77' against the shoulder 87' when plug element 91' is secured into position by any means such as a screw 93.

The idler eccentric 200 further includes a cup component 78' disposed about the lower bearing assembly 76' and secured to the upper journal 60'. Cup 78' has a closed cavity 80' formed of a cylindrical inner side wall 82' and a bottom surface 84'. Two spaced grooves 204 are formed in the inner side wall 82'. The cup 78' is disposed about the lower bearing assembly 76' and secured to lower end 86' of upper journal 60'.

The upper and lower journals 60' and 70', respectively, each have first and second longitudinal axes 88' and 90', respectively, extending therethrough.

An important aspect of the invention relates to the alignment and support means 202' disposed between cup 78' and lower bearing 76' to prevent misalignment, i.e. contact between cup 78' and lower bearing assembly 76' and to support the platform 22 with respect to base 14. As previously discussed, the prevention of misalignment, typically caused by inaccurate positioning of idler retainers 200 with respect to each other or unbalanced loads on platforms 22, allows the shaker to operate at higher speeds with no noise or stress in the platforms, reduces the manufacturing tolerances and cost of manufacturing, and allows for some angular misalignment which eases the adjustment process in positioning idler eccentric assemblies 200.

In addition, the alignment and support means 202 of the embodiment illustrated in FIGS. 5 and 6 supports platform 22 in the corners and prevents any significant up and down motion of platform 22 with respect to base 14. The substantial elimination of up and down motion of platform 22 with respect to base 14 enables heavier or unbalanced loads to be carried by platforms 22 and allows the shaker to operate at still higher speeds with no noise or stress in the platforms 22.

The alignment and support means 202 includes bumper means 96' between closed cavity 80' of cup component 78' and lower bearing assembly 76' to prevent contact of cup 78' with lower bearing assembly 76'. The bumper means 96' comprises a first bumper 98' in grooves 204 between the inner side wall of cup component 78' and the outer facing surface of outer element 83' of lower bearing assembly 76' a second bumper 102' between the upper surface of outer element 83' and the facing bottom surface of cup component 78' and a third bumper 212. The first bumper 98' consists of two o-rings and the second and third bumpers 102 and 212 each consist of a single o-ring.

The lower end of inner side wall 82 extends downward below the lower facing surface 206 of lower bearing assembly 76'. A retainer ring 208 is removably secured to the lower surface of cup component 78' by means such as a cap screw 210. The retainer ring 208 projects inwardly from the inner side wall 82' and forms a seat for the third bumper 212. When cup 78' is assembled on lower bearing 76' as discussed in detail below, the lower bearing is secured between o-ring 102' and o-ring 212.

In assembling each of the idler eccentric assemblies 200, each of the cups 78' with the o-rings 98', 100' and 102' in place can be pressed onto lower bearing 76', as illustrated in FIG. 5. Next, o-ring 212 is placed at the intersection between inner side wall 82' and the bottom surface of lower bearing 76' and the retainer ring 208 is bolted in place with cap screws 210 to secure o-ring 212 in place. The o-ring 212 is sized so that it is compressed by retaining ring 208 through the final tightening of cap screw 210. Then, each idler assembly 200 can be slipped into place between the lower platform 22 and the base 14 and the upper housing 68' and the idler post 74' are bolted into place. By slowly rotating the platform and the base, respectively, the bolts can be snugged and then tightened. Because the o-rings tend to self center, the adjustment is relatively easy. Finally, the retaining ring 208 is tightened to compress o-ring 212 against lower bearing 76'. It is important to note that the o-rings 98' 100' 102' and 212 enable the cup 78' together with upper shaft 60', to slightly give or move horizontally, vertically and angularly with respect to the lower shaft 70'. At the same time, the weight of platform 22 causes the o-ring 102' to compress so that cup 78', which is assembled on lower bearing 76', is prevented from any significant up and down movement. The result is the substantial elimination of up and down motion of platform 22 with respect to base 14.

The patents disclosed herein are incorporated by reference in their entireties.

It is apparent that there has been provided in accordance with this invention an orbiting motion shaker apparatus which fully satisfies the objects, means and advantages set forth hereinbefore. While the invention has been described in combination with the specific embodiments thereof, it is evident that many alternatives modifications, and variations will be apparent to those skilled in light of the foregoing description. Accordingly, it is intended to embrace all such alternatives, modifications, and variations as fall within the spirit and scope of the appended claims.

We claim:

1. A shaker apparatus, comprising:

platform means for carrying a load;

a base disposed beneath said platform means;

drive means carried by said base and operatively connected with said platform means for horizontal shaking of said platform means with respect to said base;

a plurality of idler eccentric means connecting said base to said platform means for maintaining said platform means in a horizontal position with respect to said base during the horizontal shaking of the platform means, each of said idler eccentric means comprising an upper journal portion in an upper bearing assembly secured to said platform means and a lower journal portion in a lower bearing assembly secured to said base, said upper and lower journal portions each having first and second longitudinal axes extending therethrough, respectively, wherein said first and second longitudinal axes are substantially parallel to and offset from each other, said idler eccentric means further including cup means disposed about said lower bearing assembly and secured to said upper journal for circular rotation about said first axis in response to a circular orbital movement of the upper journal caused by the horizontal shaking of said platform means; and alignment means associated with each of said idler eccentric means for preventing the transmission of force loadings between the platform means and the base through one of said idler eccentric means when said force loadings are generated at another of said idler eccentric means.

2. The shaker apparatus of claim 1 wherein said alignment means is disposed between said cup means and said lower bearing assembly to prevent contact of said cup means with said lower bearing assembly.

3. The shaker apparatus of claim 2 wherein said cup means has a closed cavity formed of a cylindrical inner side wall and a bottom surface; and said alignment means comprises bumper means between said closed cavity of said cup means and said lower bearing assembly to prevent contact of said cup means with said lower bearing assembly.

4. The shaker apparatus of claim 3 wherein said bumper means comprises a first bumper between said inner side wall of said cup means and said lower bearing assembly, and a second bumper between said bottom surface of said closed cavity and said lower bearing assembly.

5. The shaker apparatus of claim 6 wherein said first bumper comprises a plurality of o-rings.

6. The shaker apparatus of claim 5 wherein said second bumper comprises an o-ring disposed between the bottom surface of the cavity and the lower bearing assembly to prevent contact between said lower bearing assembly, said journal portion and said closed cavity said cup means.

7. The shaker apparatus of claim 6 wherein said lower bearing assembly comprises an inner race immovably secured to said lower journal portion and an outer race rotatable about said first axis, and said lower journal portion is immovably secured to said base.

8. The shaker apparatus of claim 9 wherein said upper journal portion includes a rotatably mounted shaft which is secured to said cup means at a location offset from said first axis, said shaft is disposed in an upper bearing assembly comprising an inner race secured to said shaft and an outer race secured within a cylindrical bore of a shaft housing, said shaft housing being secured to said platform means.

9. The shaker apparatus of claim 1 wherein said platform means includes a substantially rectangularly shaped tier secured to the bottom surface of a platform adapted for supporting a 19ad to be shaken, and said idler eccentric means are secured to each corner of said tier.

10. The shaker apparatus of claim 9 wherein said drive means includes a rotary drive shaft having a lower portion extending through said base and being rotatable about a first vertical axis of rotation, said drive shaft having an upper portion operatively connected to said platform means and being rotatable about a second vertical axis of rotation spaced from said first vertical axis of rotation.

11. The shaker apparatus of claim 10 further including counterbalancing means operatively connected to said rotary drive shaft to move therewith for horizontally balancing said shaker apparatus during operation thereof and for substantially eliminating tilting moments.

12. The shaker apparatus of claim 10 wherein said drive means includes a motor means for rotating said drive shaft, speed control means connected to said motor means for controlling the speed of rotation of said drive shaft to create the desired orbit of motion, and remote control means connected to said speed control means for setting control parameters of said speed control means.

13. The shaker apparatus of claim 12 wherein said speed control means is connected to said remote control means by fiber optic lines.

14. The shaker apparatus of claim 13 wherein said speed control means is connected to said motor means by a fiber optic line and an electric power line.

15. The shaker apparatus of claim 1 further including support means associated with each of said idler eccentric means for supporting said platform and preventing any significant up and down motion of said platform with respect to said base.

16. A shaker apparatus, comprising:

platform means for carrying a load;

a base disposed beneath said platform means; drive means carried by said base and operatively connected with said platform means for horizontal shaking of said platform means with respect to said base;

a plurality of idler eccentric means connecting said base to said platform means for guiding said platform means in a substantially planar orbit substantially parallel to said base during the horizontal shaking of the platform means; and alignment and support means associated with each of said idler eccentric means for preventing the transmission of force loadings between said platform means and said base through misalignment of said idler eccentric means and for supporting said platform means and preventing any significant up and down motion of said platform means with respect to said base;

each of said idler eccentric means comprising an upper journal portion in an upper bearing assembly secured to said platform means and a lower journal portion in a lower bearing assembly secured to said base, said upper and lower journal portions each having first and second longitudinal axes extending therethrough, respectively, wherein said first and second longitudinal axes are substantially parallel to and offset from each other;

said idler eccentric means further including cup means disposed about said lower bearing assembly and secured to said upper journal for circular rotation about said first axis in response to a circular orbital movement of the upper journal caused by the horizontal shaking of the platform means, said alignment means disposed between said cup means and said lower bearing assembly to prevent contact of said cup means with said lower bearing assembly.

17. The shaker apparatus of claim 16 wherein said cup means has a closed cavity formed of a cylindrical inner side wall and a bottom surface; and said alignment means comprises bumper means between the closed cavity of said cup means and said lower bearing assembly to prevent contact of said cup means with said lower bearing assembly and to further prevent any significant up and down motion of said platform means with respect to said base.

18. The shaker apparatus of claim 17 wherein said bumper means comprises a first bumper between the inner side wall of said cup means and said lower bearing assembly, a second bumper between the bottom surface of said cavity and said lower bearing assembly and a third bumper between an inner side wall of said cup means and the bottom surface of said lower bearing assembly.

19. The shaker apparatus of claim 18 wherein said first, second, and third bumpers comprise an o-ring.

20. The shaker apparatus of claim 19 further including a retaining ring removably secured to said cup component to compress said third bumper against said lower bearing assembly.

21. The shaker apparatus of claim 20 wherein said second bumper comprises an o-ring disposed between the bottom surface of said cavity and said lower bearing assembly to prevent contact between said bearing assembly, said journal portion, and said closed cavity of said cup means.

* * * * *